US008073375B2

(12) United States Patent
Hiraoka et al.

(10) Patent No.: US 8,073,375 B2
(45) Date of Patent: Dec. 6, 2011

(54) FIXING UNIT AND IMAGE FORMING APPARATUS HAVING THE SAME

(75) Inventors: Chikara Hiraoka, Hitachi (JP); Kazuhiro Wakamatsu, Hitachi (JP); Katsumi Kumada, Hitachi (JP)

(73) Assignee: Ricoh Company, Ltd., Tokyo (JP)

( * ) Notice: Subject to any disclaimer, the term of this patent is extended or adjusted under 35 U.S.C. 154(b) by 565 days.

(21) Appl. No.: 12/208,099

(22) Filed: Sep. 10, 2008

(65) Prior Publication Data

US 2009/0110448 A1 Apr. 30, 2009

(30) Foreign Application Priority Data

Oct. 26, 2007 (JP) ..... 2007-278896

(51) Int. Cl.
*G03G 15/20* (2006.01)
*G03G 15/16* (2006.01)

(52) U.S. Cl. ..... 399/329; 399/122; 399/328; 399/330; 399/331

(58) Field of Classification Search ..... 399/122, 399/328, 329, 330, 331
See application file for complete search history.

(56) References Cited

U.S. PATENT DOCUMENTS

| | | | | |
|---|---|---|---|---|
| 6,063,160 | A * | 5/2000 | Krogerus et al. | 75/757 |
| 6,631,252 | B2 * | 10/2003 | Ando et al. | 399/328 |
| 6,904,257 | B2 * | 6/2005 | Tomatsu | 399/328 |
| 2003/0118382 | A1 * | 6/2003 | Tomatsu | 399/328 |
| 2005/0141914 | A1 * | 6/2005 | Hiraoka et al. | 399/69 |
| 2006/0008282 | A1 * | 1/2006 | Aratachi et al. | 399/33 |
| 2006/0216060 | A1 * | 9/2006 | Kuwata et al. | 399/110 |
| 2006/0239715 | A1 * | 10/2006 | Lee et al. | 399/122 |
| 2007/0230983 | A1 * | 10/2007 | Nakamoto et al. | 399/69 |
| 2008/0260425 | A1 * | 10/2008 | Hirayama et al. | 399/122 |
| 2008/0292374 | A1 * | 11/2008 | Hiraoka et al. | 399/328 |
| 2008/0310895 | A1 * | 12/2008 | Masuda et al. | 399/331 |

FOREIGN PATENT DOCUMENTS

| | | | |
|---|---|---|---|
| JP | 04204471 | A * | 7/1992 |
| JP | 10-10912 | A | 1/1998 |
| JP | 2002-311743 | A | 10/2002 |
| JP | 2004-29610 | A | 1/2004 |
| JP | 2004-126317 | A | 4/2004 |
| JP | 2005-189307 | A | 7/2005 |
| JP | 2006-53302 | A | 2/2006 |
| JP | 2006-235330 | A | 9/2006 |
| JP | 2008176087 | A * | 7/2008 |

* cited by examiner

*Primary Examiner* — David Gray
*Assistant Examiner* — Francis Gray
(74) *Attorney, Agent, or Firm* — Crowell & Moring LLP

(57) ABSTRACT

A fixing unit where an operating force for releasing a nip can be reduced with a small-sized configuration. The fixing unit has a heating roller including a heating element, a pressure belt, pressure arms, pressure springs, and nip load releasing units. The pressure belt is supported in an intermediate position between the pressure arms 3. One end portions of the pressure arms are brought into contact with the pressure springs respectively. The other end portions of the pressure arms are brought into contact with the nip load releasing units respectively. When a load applied to the pressure belt is released by the nip load releasing units, the other end portions of the pressure arms move away from the heating roller.

8 Claims, 8 Drawing Sheets

FIXING UNIT AND IMAGE FORMING APPARATUS HAVING THE SAME

FIELD OF THE INVENTION

The present invention relates to an image forming apparatus such as a copying machine, a printer or the like using electro photography, and particularly relates to a fixing unit in which jammed paper can be removed easily with a reduced operating force when a paper jam occurs in the fixing unit.

BACKGROUND OF THE INVENTION

A fixing unit in an image forming apparatus is designed as follows. That is, a heating roller has a core including a heater, and a layer formed around the core. The layer provides heat resistance and toner releasability. A pressure belt or a pressure roller is brought into contact with the heating roller with a certain load by use of a spring. Thus a nip portion is formed. Paper where an unfixed toner image has been formed is passed through the nip portion. Thus the toner image is fixed to the paper.

Due to such a configuration, when a paper jam occurs in the fixing unit, the pressure belt or the pressure roller has to be retracted from the heating roller so as to release the nip load applied to the heating roller in order to remove jammed paper. A mechanism using an eccentric cam driving unit to automatically move a frame engaging with he pressure belt or the pressure roller has been proposed as means for releasing the nip load (for example, Patent Document 1).

There has been used another means in which a lever is provided to come in contact with a member engaging with the pressure belt or the pressure roller so that the nip load can be released when a user operates the lever. A background-art example of a fixing unit using a pressure belt is shown in FIGS. 10A and 10B. FIG. 10A is a sectional view showing a state where the nip load has not been released, and FIG. 10B is a sectional view showing a state where the nip load has been released.

The fixing unit has a heating roller 1, a pressure belt 2, pressure arms 3, side plates 4, and so on. The heating roller 1 is an elastic roller in which a core 1*a* is coated with an elastic layer 1*b* made of silicon rubber or the like. The surface of the heating roller 1 is coated with PFA (tetrafluoride-perfluoroalkylvinyl ether copolymer) in order to secure releasability from toner. The heating roller 1 has a heater 5 in it. Toner is fused by heat from the heater 5. The heating roller 1 is rotatably supported on the side plates 4. The heating roller 1 is rotated in the arrow A direction by a not-shown driving unit composed of a motor.

The pressure belt 2 is, for example, made of a seamless polyimide film. The surface of the pressure belt 2 is coated with PFA in order to secure releasability from toner. The pressure belt 2 is suspended by a pressure unit 6 constituted by pressure members 6*a* and 6*b* and a pressure roller 6*c*. The pressure belt 2 is brought into contact with the heating roller 1 at an angle θ of contact by pressure springs 8 in cooperation with pressure stays 7 and the pressure arms 3 with a shaft 9 provided on the side plates 4 as a base point. Thus, the pressure belt 2 forms a nip (contact) portion h for fusing toner between the heating roller 1 and the pressure belt 2. At the same time, the pressure belt 2 rotates with the heating roller 1 due to the rolling friction of the heating roller 1.

Nip load releasing units 30 are placed in positions opposed to pressing portions of the pressure springs 8 and near tip portions of the pressure arms 3 respectively. The nip load releasing units 30 are supported on the side plates 4. Each nip load releasing unit 30 is constituted by an operating lever 30*a* and a support member 30*b* supporting the operating lever 30*a* rotatably in the arrow B direction. In the state of FIG. 10A where the nip load has not been released, the operating lever 30*a* is not in contact with a tip portion of the pressure arm 3, but the length of the pressure spring 8 pressing the pressure arm 3 toward the heating roller 1 is L1.

When paper jammed in the fixing unit is to be removed, a user rotates each operating lever 30*a* in the arrow B direction by an operating force F as shown in FIG. 10B. Thus, the operating lever 30*a* comes in contact with a tip portion of the pressure arm 3 so as to retract the pressure arm 3 and the pressure unit 6 around the shaft 9 and against the elasticity of the pressure spring 8. Due to such a structure, the pressure spring 8 is compressed so that the length thereof becomes L2 shorter than that when the nip load has not been released.

Patent Document 1: JP-A-10-10912

Such a background-art structure has the following problems. First, in the mechanism in which an eccentric cam driving unit is used to automatically move a frame engaging with a pressure belt or a pressure roller as disclosed in Patent Document 1, the number of parts increases due to the driving mechanism and so on. It is therefore difficult to make the apparatus smaller in size and lower in cost.

In the structure in which a user operates the operating levers 30*a* so as to release the nip load as shown in FIGS. 10A and 10B, the pressure springs 8 pressing the pressure arms 3 are displaced by the operating levers 30*a* in directions where the pressure springs 8 are compressed. Accordingly, the operating force of the user is so excessive that there occurs a problem in operating performance. It is generally desired that the operating force for a user to operate a lever or the like is not larger than 20 [N]. An operating force larger than 20 [N] does not only gives the user a sense of difficulty in operating, but also may injure user's hands. In the fixing unit using a pressure belt as shown in FIGS. 10A and 10B, however, the total nip portion contact load applied to the heating roller by the pressure belt reaches about 300-400 [N]. An excessive operating force is required for the operating levers 30*a*.

In order to reduce the operating force F of the operating lever, the operating lever ratio (b/a) shown in FIG. 10B has to be increased, that is, the operating lever length b has to be enlarged. As a result, the operating levers 30*a* become so long that there occurs a great obstacle to miniaturization of the apparatus.

SUMMARY OF THE INVENTION

An object of the present invention is to solve the foregoing problems in the background art. Another object of the present invention is to provide a fixing unit in which an operating force for releasing a nip can be reduced by a small-sized and low-priced configuration while the unit is user-friendly. Further another object of the present invention is to provide an image forming apparatus having the fixing unit.

In order to attain the foregoing objects, a first configuration of the present invention provides a fixing unit including:

a heating member including a heating element such as a heater;

a pressure conveyance member such as a pressure belt or a pressure roller for conveying a recording medium such as paper, which is carrying a toner image, in cooperation with the heating member while pressing the recording medium toward the heating member;

support members such as pressure arms which can rotatably support opposite end portions of the pressure conveyance member respectively;

pressure springs which can apply a predetermined load to the pressure conveyance member through the support members respectively so as to press the pressure conveyance member toward the heating member; and nip load releasing units which can release the load applied to the pressure conveyance member by the pressure springs respectively.

The fixing unit is characterized in that:

the pressure conveyance member is supported in an intermediate position between the support members, while one end portions of the support members are brought into contact with the pressure springs respectively; and the other end portions of the support members on the opposite side to the pressure springs are brought into contact with the nip load releasing units respectively, so that the other end portions of the support members can move away from the heating member when the load applied to the pressure conveyance member is released by the nip load releasing units.

According to a second configuration of the present invention, the fixing unit according to the first configuration is characterized in that stoppers are fixed through a gap to the one end portions of the support members brought into contact with the pressure springs and on opposite side to the pressure springs respectively, and when the load applied to the pressure conveyance member is released by the nip load releasing units, the one end portions of the support members are brought into contact with the stoppers, and the support members rotate around contact points with the stoppers respectively so as to move away from the heating member.

According to a third configuration of the present invention, the fixing unit according to the first or second configuration is characterized in that:

each of the nip load releasing units has an operating lever and a rotary support shaft which rotatably supports the operating lever;

the rotary support shafts are attached respectively to side plates which rotatably support opposite end portions of the heating member on both sides respectively;

a shaft for connecting the support members which rotatably support the opposite end portions of the pressure conveyance member on the both sides respectively is provided so that opposite end portions of the shaft project outside over the support members respectively, while long holes to which the opposite end portions of the shaft can be fitted are formed in the side plates respectively;

when the pressure conveyance member is being pressed toward the heating member, the operating levers of the nip load releasing units are brought into contact with portions of the shaft respectively, and the opposite end portions of the shaft are pressed onto one end portions of the long holes respectively so that the shaft is positioned; and when the load applied to the pressure conveyance member is to be released, the operating levers of the nip load releasing units are rotated to release the shaft from pressure, so that the opposite end portions of the shaft move along the long holes respectively due to a reaction force applied to the pressure conveyance member by the heating member.

According to a fourth configuration of the present invention, the fixing unit according to the third configuration is characterized in that the rotary support shafts of the nip load releasing units are placed in a direction of the reaction force of the heating member acting on the shaft when the operating levers press the shaft.

According to a fifth configuration of the present invention, the fixing unit according to the first or second configuration is characterized by further including:

a heating unit including the heating member and the side plates which rotatably support opposite end portions of the heating member on both sides respectively; and a pressure unit including the pressure conveyance member and the support members which rotatably support opposite end portions of the pressure conveyance member on the both sides respectively; wherein:

projecting portions which project outside are provided in the support members in positions corresponding to the nip load releasing units respectively, while long holes to which the projecting portions can be fitted are formed in the side plates on the both sides respectively; and when the projecting portions are fitted to the long holes respectively, the pressure unit can be removably attached to the heating unit.

According to a sixth configuration of the present invention, the fixing unit according to the third or fifth configuration is characterized in that the long holes are long holes which are narrowed toward inner sides of the side plates respectively, and each long hole has a U-groove shape in which a notch portion is formed in one end thereof, while the long holes face in directions where the other end portions of the support members can move away from the heating member respectively when the load applied to the pressure conveyance member is to be released.

According to a seventh configuration of the present invention, the fixing unit according to the fifth configuration is characterized in that the projecting portions of the support members are opposite end portions of a shaft which connects the support members placed on the both sides and penetrates the support members.

An eighth configuration of the present invention provides an image forming apparatus including a photoconductor unit for forming a toner image, a charging unit for charging a surface of the photoconductor unit uniformly, an exposure unit for exposing the charged surface of the photoconductor unit to light so as to form an electrostatic latent image, a developing unit for applying toner to the electrostatic latent image so as to form a toner image, a transfer unit for transferring the toner image to a recording medium, and a fixing unit for fixing the transferred toner image to the recording medium. The image forming apparatus is characterized in that the fixing unit is a fixing unit according to any one of the first through seventh configurations.

According to the present invention, due to the aforementioned configurations, it is possible to provide a fixing unit in which an operating force for releasing a nip can be reduced by a small-sized and low-priced configuration with a reduced number of parts and without increasing the cost while the unit is user-friendly. In addition, it is possible to provide an image forming apparatus having the fixing unit.

BRIEF DESCRIPTION OF THE DRAWINGS

FIG. 2A is a view showing a normal operation state of the fixing unit, and FIG. 2B is a view showing a state where a user has operated operating levers to reduce a contact load applied to a heating roller by a pressure belt in order to remove jammed paper;

FIG. 9A is a view showing a normal operation state of the fixing unit, and FIG. 9B is a view showing a state where a user has operated operating levers to reduce a contact load applied to a heating roller by a pressure roller in order to remove jammed paper; FIG. 10A is a view showing a normal operation state of the fixing unit, and FIG. 10B is a view showing a state where a user has operated operating levers to reduce a contact load applied to a heating roller by a pressure belt in order to remove jammed paper.

DETAILED DESCRIPTION OF THE EMBODIMENTS

Embodiments of the present invention will be described below with reference to the drawings. First, the schematic configuration of an image forming apparatus according to an embodiment of the present invention will be described with reference to FIG. 7.

Figure 7:
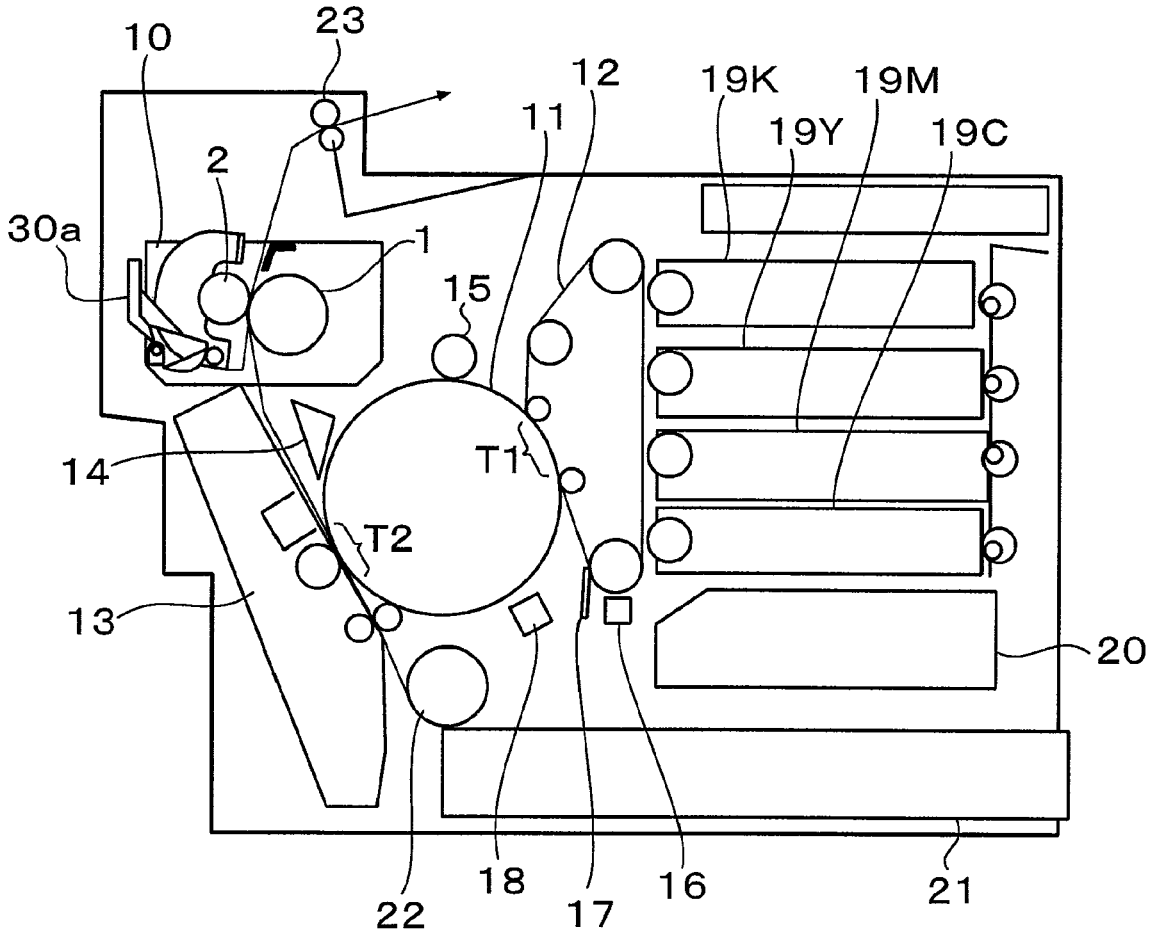
FIG. 7 is a schematic configuration view of an image forming apparatus according to the embodiment of the present invention.

As shown in FIG. 7, an intermediate transfer unit 11 is disposed in a central portion of the apparatus. A photoconductor unit 12, a transfer unit 13, a paper releasing unit 14 and an intermediate transfer unit cleaning unit 15 are disposed around the intermediate transfer unit 11. A charging unit 16, a photoconductor cleaning unit 17 and an afterimage eliminating unit 18 are disposed around the photoconductor unit 12.

Further, developing units 19K, 19Y, 19M and 19C charged with toner composed of microscopic color powder of four different colors respectively are provided near the photoconductor unit 12 so as to be put on top of one another. An exposure unit 20 is disposed under the developing units 19K, 19Y, 19M and 19C. A paper holding unit 21 and a paper feeding unit 22 are disposed under the exposure unit 20. The paper holding unit 21 stocks paper. A fixing unit 10 and a paper delivery unit 23 are provided in an upper portion of the apparatus.

In this configuration, the charging unit 16 charges a drum surface of the photoconductor unit 12 uniformly. The exposure unit 20 performs exposure upon each dot based on image or character information from a personal computer, an image scanner or the like. Thus, an electrostatic latent image is formed on the surface of the photoconductor unit 12.

After that, toner is supplied and applied to the electrostatic latent image by one of the developing units 19K, 19Y, 19M and 19C so as to visualize the electrostatic latent image as a toner image. The toner image is conveyed to a first transfer position T1.

In the first transfer position T1, the toner image is transferred to a surface of the intermediate transfer unit 11 by the difference between the potential of the photoconductor unit 12 and the potential of the intermediate transfer unit 11 supplied from a not-shown power supply. The surface of the photoconductor unit 12 having passed through the first transfer position T1 is irradiated with light by the afterimage eliminating unit 18. Thus the potential of the surface of the photoconductor unit 12 is dropped down below a predetermined value, so that the electrostatic latent image is eliminated. Residual toner which has not been transferred in the first transfer position T1 but stayed on the surface is cleaned up by the photoconductor cleaning unit 17. Thus the surface of the photoconductor unit 12 gets ready for formation of the next toner image. The aforementioned process is repeated a required number of times by the developing units 19K to 19C. Thus, a color toner image corresponding to the image or character information is formed on the surface of the intermediate transfer unit 11.

After that, in a second transfer position T2, the transfer unit 13 transfers the color toner image to paper supplied from the paper holding unit 21 by the paper feeding unit 22. The paper to which the toner image has been transferred is released from the intermediate transfer unit 11 by the paper releasing unit 14, and conveyed to the fixing unit 10, where the toner image is fixed onto the paper. The paper is delivered by the paper delivery unit 23.

Next, description will be made about removal of jammed paper when a paper jam occurs.

Figure 8:
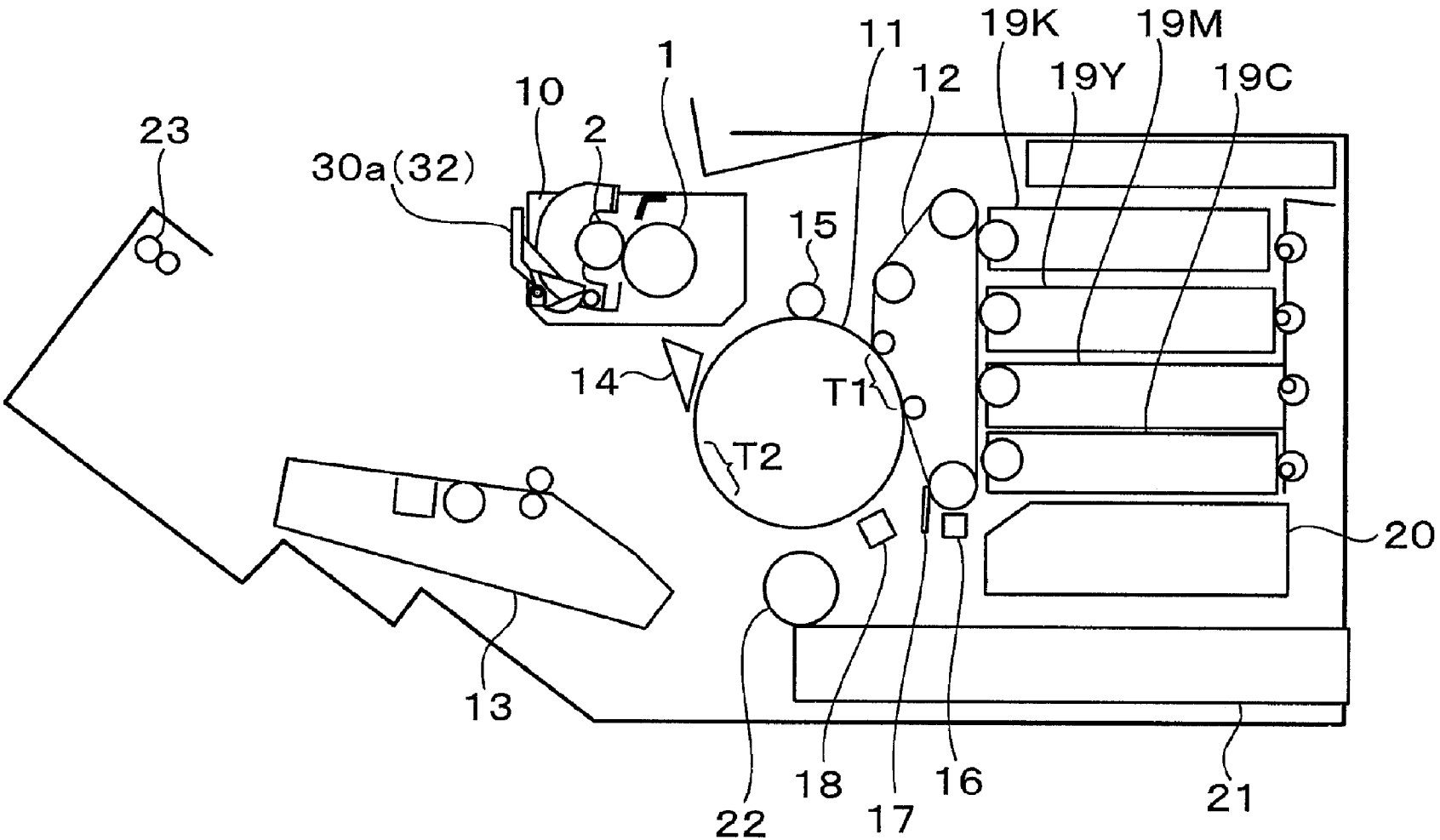
FIG. 8 is a schematic configuration view of the image forming apparatus where a frame has been opened from an image forming apparatus body.

The transfer unit 13 and the paper delivery unit 23 are placed on a frame which is openably/closably attached to an image forming apparatus body. The fixing unit 10 is attached to the image forming apparatus body. When a paper jam occurs, the fixing unit 10 and control levers 30*a* for the fixing unit 10 can be exposed if the frame is opened from the image forming apparatus body as shown in FIG. 8. How to remove jammed paper in the fixing unit 10 will be described in detail later. In brief, a user can operate the operating levers 30*a* so as to move a pressure belt 2 away from a heating roller 1.

Figure 1:
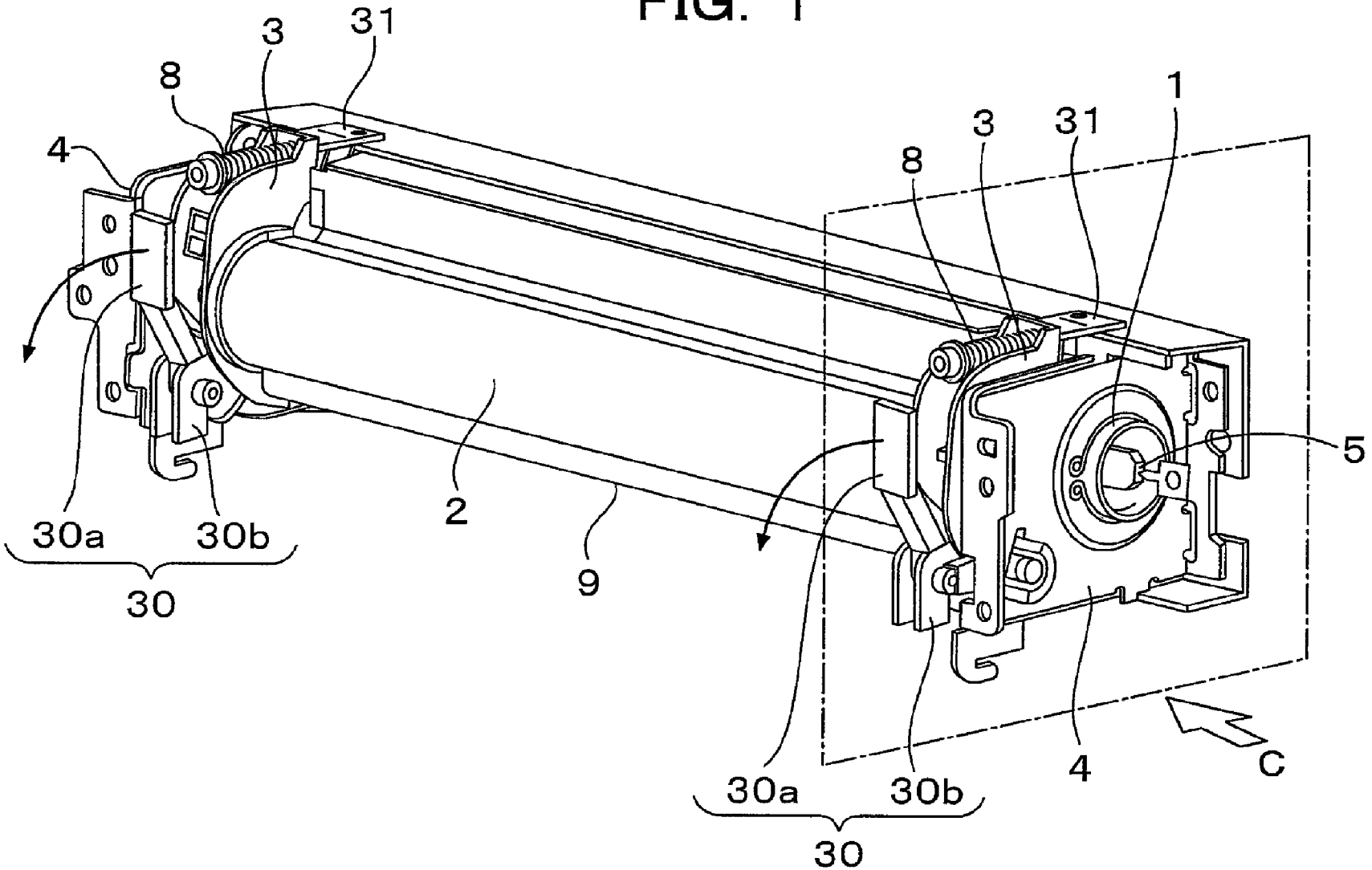
FIG. 1 is a general perspective view of a fixing unit according to an embodiment of the present invention.
Figure 2A:
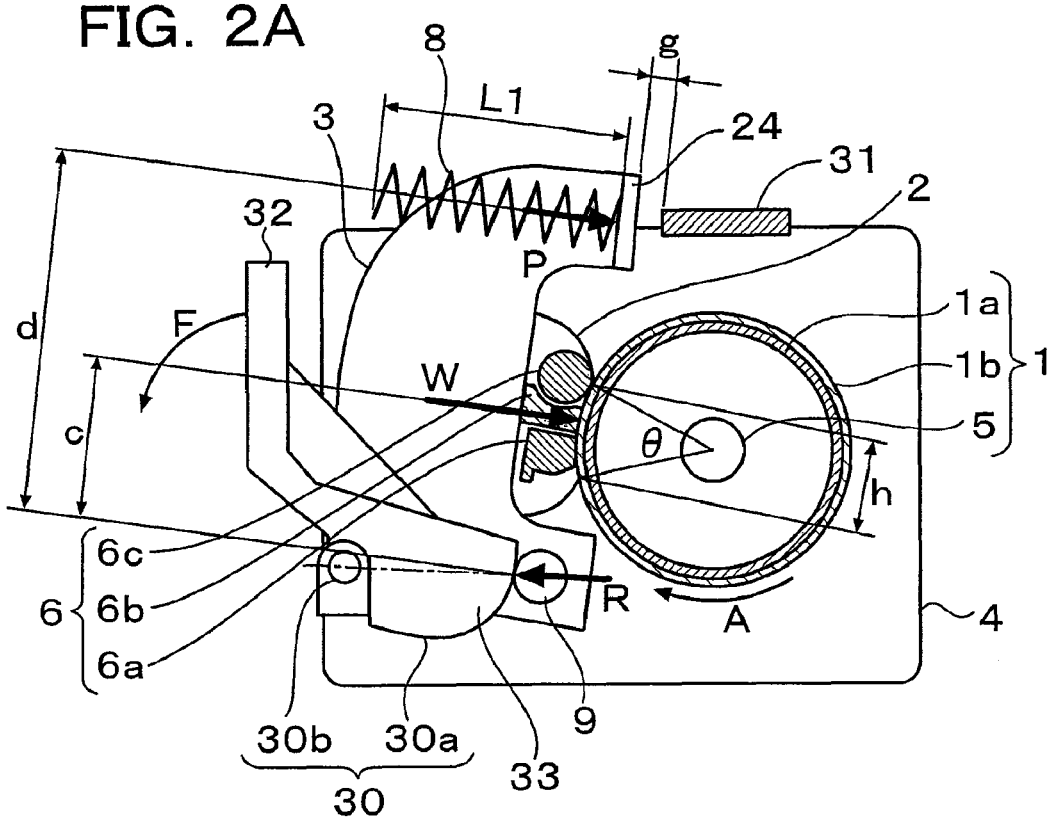
FIGS. 2A and 2B are partially sectional side views of the fixing unit.
Figure 2B:
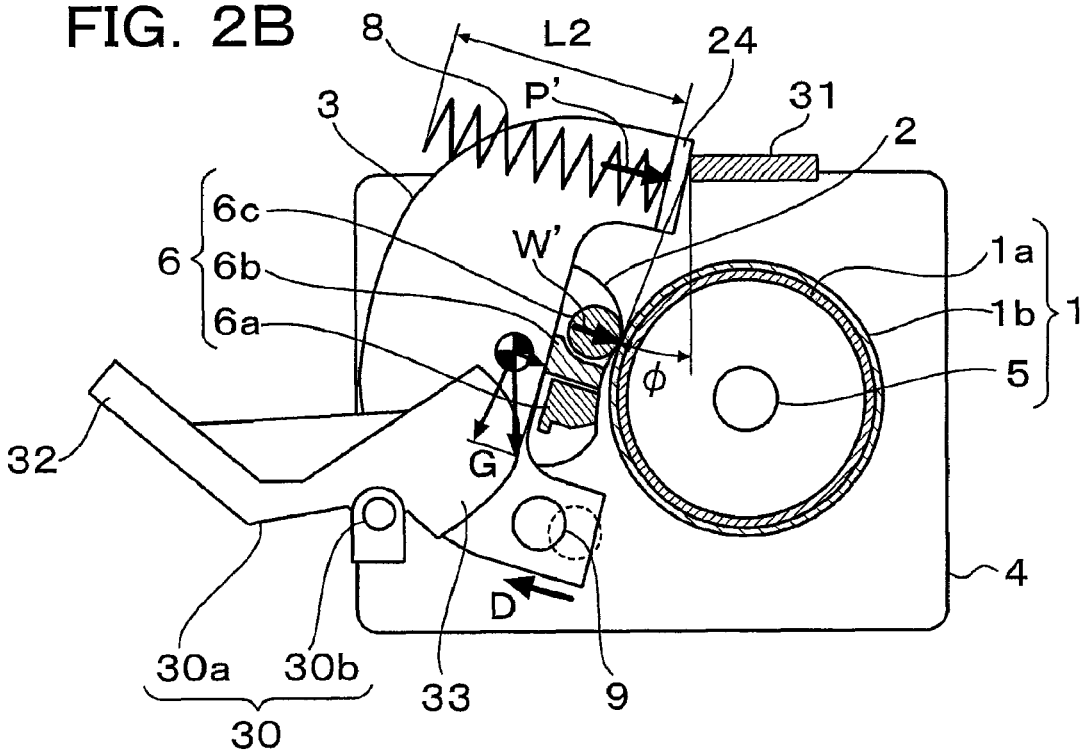
Figure 3:
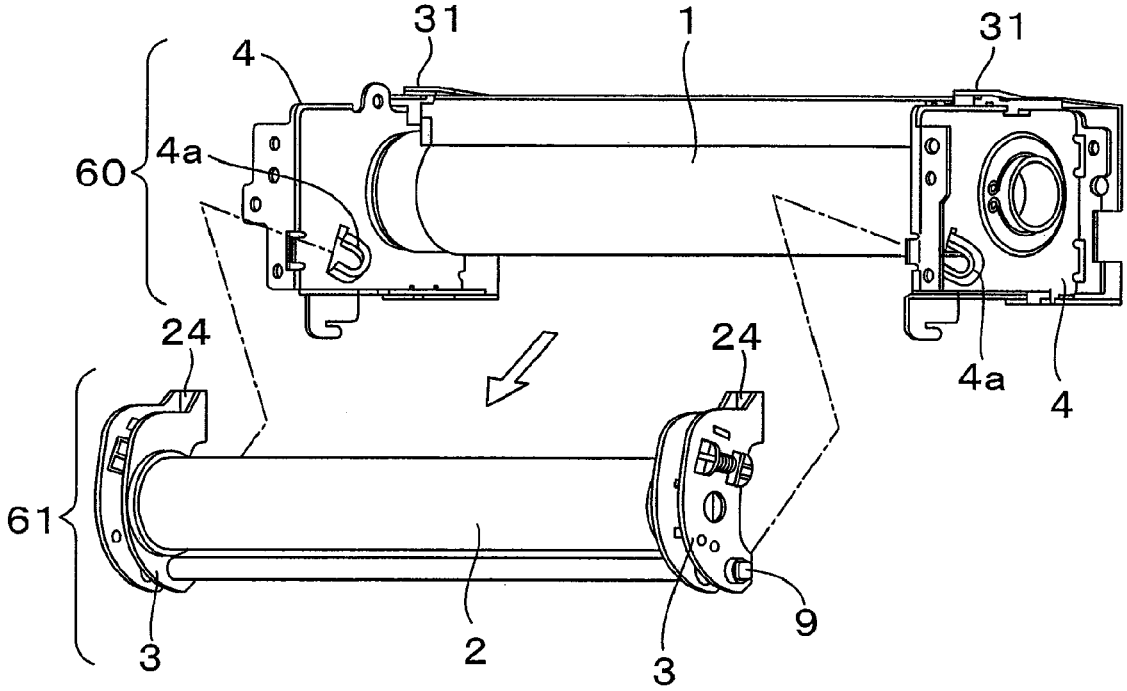
FIG. 3 is an exploded perspective view of the fixing unit.

Next, description will be made about the configuration of the fixing unit. FIG. 1 is a general perspective view of the fixing unit. FIGS. 2A and 2B are partially sectional side views of the fixing unit. FIG. 3 is an exploded perspective view of the fixing unit.

The fixing unit is chiefly constituted by a heating roller 1, a pressure belt 2 disposed substantially in parallel with the heating roller 1, two pressure arms 3, and two side plates 4 supporting the pressure arms 3 respectively.

As shown in FIGS. 2A and 2B, the heating roller 1 is an elastic roller in which the peripheral surface of a core 1*a* is coated with an elastic layer 1*b* made of silicon rubber or the like. The surface of the elastic layer 1*b* is coated with PFA (tetrafluoride-perfluoroalkylvinyl ether copolymer) in order to secure releasability from toner. The heating roller 1 has a heater 5 in it. Toner is fused by heat from the heater 5. The opposite end portions of the heating roller 1 are rotatably supported on the two side plates 4 and 4 respectively. The heating roller 1 is rotated in the arrow A direction by a not-shown driving unit composed of a motor.

The pressure belt 2 is made of a seamless polyimide film or the like. The surface of the pressure belt 2 is coated with PFA in order to secure releasability from toner. The pressure belt 2 is suspended by a pressure unit 6 constituted by pressure members 6*a* and 6*b* and a pressure roller 6*c*. The pressure belt 2 is brought into contact with the heating roller 1 at an angle θ of contact by the elastic force of pressure springs 8 in cooperation with the pressure arms 3. Thus, the pressure belt 2 forms a nip (contact) portion h for fusing toner between the heating roller 1 and the pressure belt 2. In the nip (contact) portion h, the pressure belt 2 conveys the paper holding toner on it in cooperation with the heating roller 1 while pressing the paper toward the heating roller 1.

Each pressure arm 3 has a substantially C-shaped side surface. The pressure belt 2 and the pressure unit 6 are supported between the two pressure arms 3 and in vertically intermediate positions of the pressure arms 3 so as to project toward the heating roller 1.

The opposite end portions of a shaft 9 penetrate lower end portions of the pressure arms 3 respectively. Thus the pressure arms 3 are connected to the two side plates 4 through the shaft 9 respectively. A spring contact portion 24 having a U-shaped planar shape is provided in an upper end portion of each pressure arm 3. A tip portion of the pressure spring 8 is inserted to the inside of the spring contact portion 24 so as to come into contact therewith. A base end portion of the pressure spring 8 is fixed to a not-shown fixation portion. Thus, each pressure arm 3 is elastically urged toward the heating roller 1 by the pressing force of the pressure spring 8 with the shaft 9 as a base point. As a result, the pressure belt 2 is brought into pressure contact with the heating roller 1 over a predetermined nip width. The opposite end portions of the shaft 9 are fitted into long holes 4*a* (see FIGS. 3 and 4) provided in the side plates 4, and positioned by nip load releasing units 30, respectively.

Next, each nip load releasing unit 30 will be described chiefly with reference to FIGS. 2A and 2B. FIGS. 2A and 2B are views where the position shown by the chain line in FIG. 1 is viewed from the direction C. FIG. 2A is a view showing the state where a toner image is fixed to paper, that is, the pressure belt 2 is brought into pressure contact with the heating roller 1 by a predetermined load. FIG. 2B is a view showing the state where a user has operated the operating levers 30*a* so as to reduce the contact load applied to the heating roller 1 by the pressure belt 2 in order to remove jammed paper.

The nip load releasing units 30 are supported on the side plates 4 on the both sides respectively as shown in FIG. 1. Each nip load releasing unit 30 is constituted by the operating lever 30*a* and a rotary support shaft 30*b* rotatably supporting the operating lever 30*a*. A base end portion of the rotary support shaft 30*b* is fixed to its corresponding side plate 4.

Figure 5:
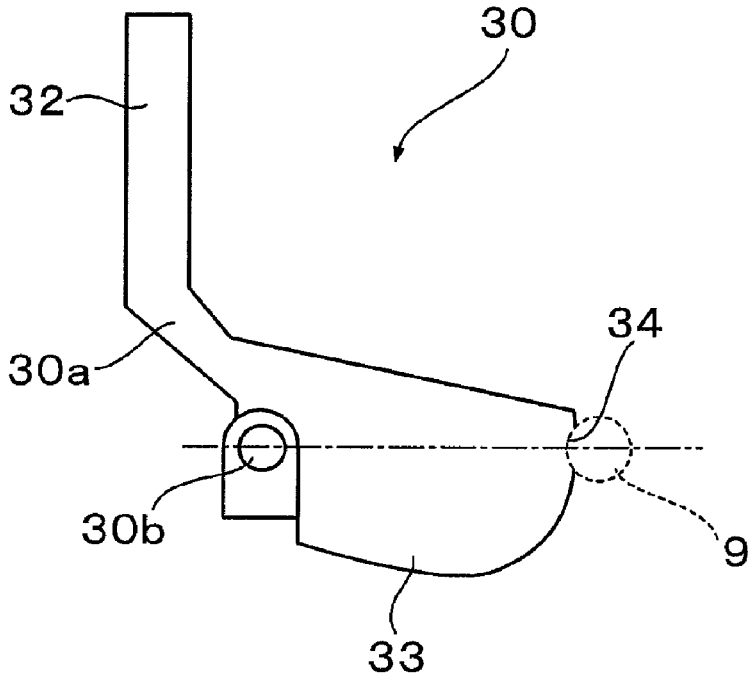
FIG. 5 is an enlarged side view of a nip load releasing unit.

FIG. 5 is an enlarged side view of the nip load releasing unit 30. As shown in FIG. 5, the operating lever 30*a* has a knob portion 32 in one end and a contact portion 33 in the other end. The contact portion 33 has an edge formed into an arc. An intermediate portion between the knob portion 32 and the contact portion 33 is supported by the rotary support shaft 30*b* so as to rotate around the rotary support shaft 30*b*. A trap portion 34 shaped into a small arc is formed near an upper end portion of the contact portion 33 so as to trap a part of the peripheral portion of the shaft 9. When a paper jam occurs, the frame to which the transfer unit 13 and the paper delivery unit 23 have been attached is opened from the image forming apparatus body as shown in FIG. 8, so that the knob portion 32 can be exposed.

As shown in FIGS. 2A and 2B, a stopper 31 is disposed in a position (on the opposite side to the pressure spring 8) where the stopper 31 is opposed through a gap g to the spring contact portion 24 which is provided in an upper end portion of each pressure arm 3. The stoppers 31 are fixed to upper portions of the two side plates 4 respectively.

FIG. 3 is an exploded perspective view of the fixing unit. As shown in FIG. 3, the fixing unit can be exploded into a heating roller unit 60 and a pressure unit 61.

The heating roller unit 60 is a unit integrally constituted by the heating roller 1, the side plates 4 and the stoppers 31. The pressure unit 61 is a unit integrally constituted by the pressure belt 2, the pressure arms 3 and the shaft 9. The pressure unit 61 has a structure which can be separated from the heating roller unit 60.

Figure 4:
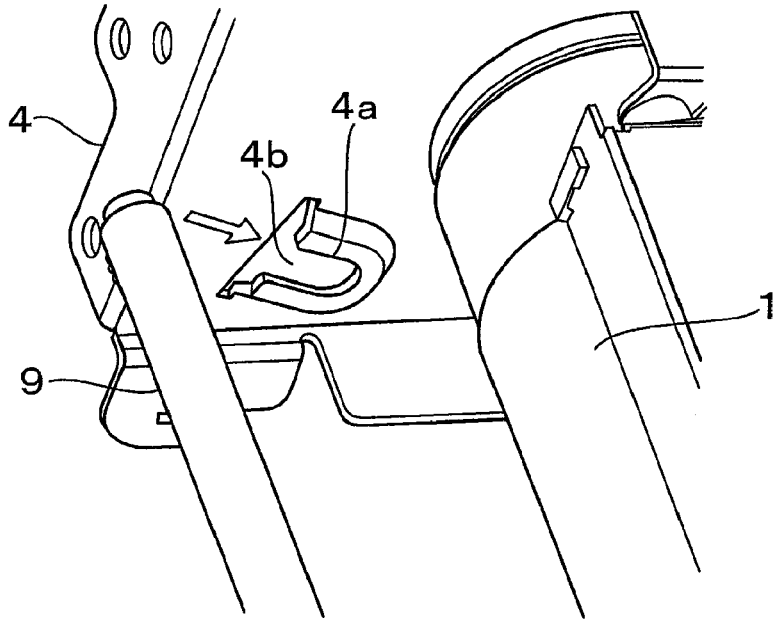
FIG. 4 is an enlarged and exploded perspective view of the vicinities of a portion where a shaft is fitted to a side plate.

FIG. 4 is an enlarged and exploded perspective view of the vicinities of a portion where the shaft 9 is fitted to the side plate 4. In order to simplify the illustration, the pressure belt 2, the pressure arm 3 and so on are not shown in FIG. 4.

As shown in FIGS. 3 and 4, long holes 4*a* are formed in positions where the pressure unit 61 will be attached to the side plates 4 on the both sides, respectively. A circumferential portion of each long hole 4*a* has a shape narrowed toward the inner side of its corresponding side plate 4, and has a notch portion 4*b* in its one end. Thus, the long hole 4*a* has a U-groove shape inclined obliquely upward.

Tip portions (projecting portions) of the shaft 9 projecting outside over the pressure arms 3 have stepped shapes which can engage with the long holes 4*a* respectively so as to prevent the shaft 9 from being detached. Thus, the shaft 9 has a structure where the tip portion of the shaft 9 can be inserted easily in the illustrated arrow direction so as to engage with the long holes 4*a*. Accordingly, when the opposite end portions of the shaft 9 are inserted into the hole holes 4*a* and the knob portions 32 of the operating levers 30*a* are erected as shown in FIG. 2A, the pressure unit 61 can be removably attached to the heating roller unit 60.

Figure 6:
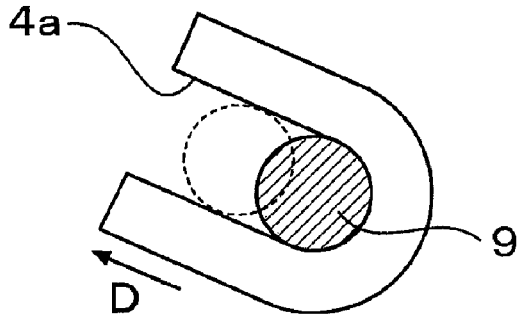
FIG. 6 is a view showing a position of the shaft in a long hole of the side plate.

FIG. 2A shows the state where the fixing unit is operating normally. In FIG. 2A, the knob portion 32 of each operating lever 30*a* is erected substantially perpendicularly. Accordingly, a part of the peripheral portion of the shaft 9 is fitted into the trap portion 34 provided in the upper portion of the contact portion 33. Thus, the contact portion 33 is in contact with the shaft 9. FIG. 6 is a view showing the position of the shaft 9 in the long hole 4*a* of the side plate 4. In the normal state, the shaft 9 is thrust into the deepest side of the long hole 4*a* by the contact portion 33 of the operating lever 30*a* as shown by the solid line. Thus, the shaft 9 is positioned in the U-groove portion (arc portion).

In this state, the rotary support shaft 30*b* receives a reaction force R acting on the shaft 9. Thus, rotation moment can be prevented from acting on the operating lever 30*a* due to the counter force R. In this normal state, the tip portion (spring contact portion 24) of the pressure arm 3 is opposed to the stopper 31 through the gap g.

Next, description will be made about forces acting on respective portions in the state of FIG. 2A, that is, in the state where the pressure belt 2 is in normal contact with the heating roller 1.

Assume that a pressure spring force P acts on the tips of each pressure arm 3 in accordance with spring length L1 of each pressure spring 8, a total nip load W acts on nip width h of the pressure belt 2 in contact with the heating roller 1, and a reaction force R acts on the shaft 9. When c and d designate a distance between the center of the shaft 9 and a point of application of the nip load W and a distance between the center of the shaft 9 and a point of application of the pressure spring 8 respectively, the following relations are established by equilibrium of force and equilibrium of moment.

$$cW=2dP$$

$$2P=W+2R$$

From the above expressions, the reaction force R can be expressed by R=(1-d/c)P (where the direction of the spring load P of the pressure spring 8 is positive).

To remove jammed paper in the fixing unit, the frame is first opened from the image forming apparatus body as shown in FIG. 8. Thus, the fixing unit 10 and the operating levers 30*a* therefore are exposed. Then a user rotates the knob portions 32 of the operating levers 30*a* in the direction of the illustrated arrow F as shown in FIG. 2A. FIG. 2B is a view showing the state where the operating levers 30*a* have been thus operated to reduce the contact load applied to the heating roller 1 by the pressure belt 2.

In the aforementioned operation, the operating levers 30*a* rotate around the rotary support shafts 30*b* respectively so that the contact portions 33 of the operating levers 30*a* are detached from the shaft 9. The shaft 9 loses the support of the contact portions 33. Thus the shaft 9 is moved in the arrow D direction within each long hole 4*a* by the aforementioned reaction force R while the tip portions (spring contact portions 24) of the pressure arms 3 are displaced to come in contact with the stoppers 31 by the loads of the pressure springs 8 respectively.

Figure 10A:
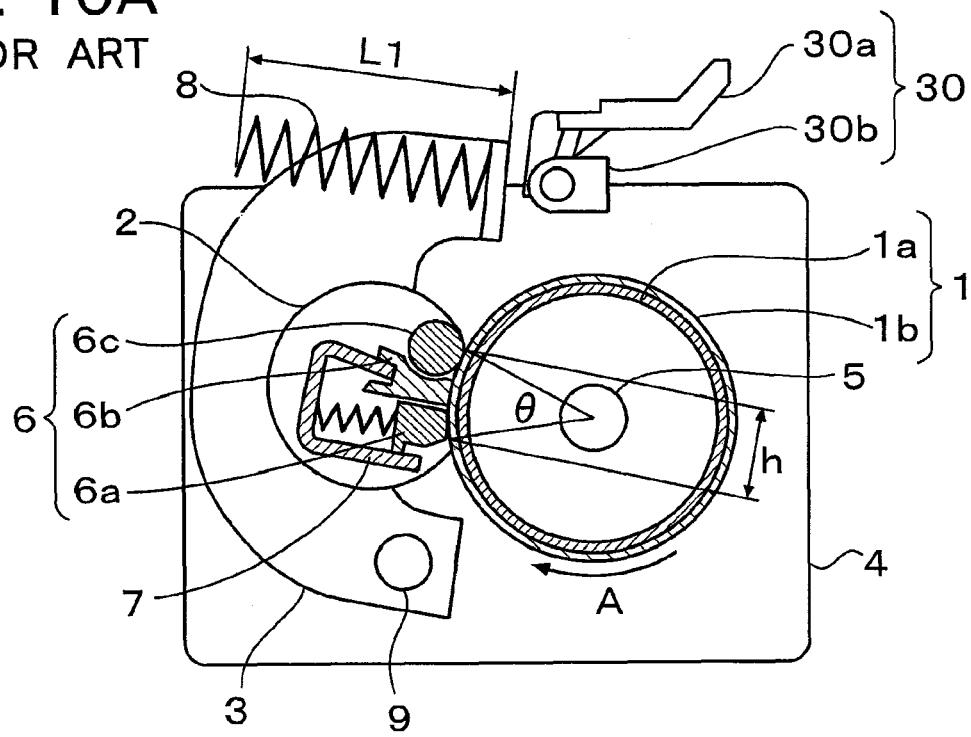
FIG. 10A PRIOR ART
FIGS. 10A and 10B are partially sectional side views of a background-art fixing unit.
Figure 10B:
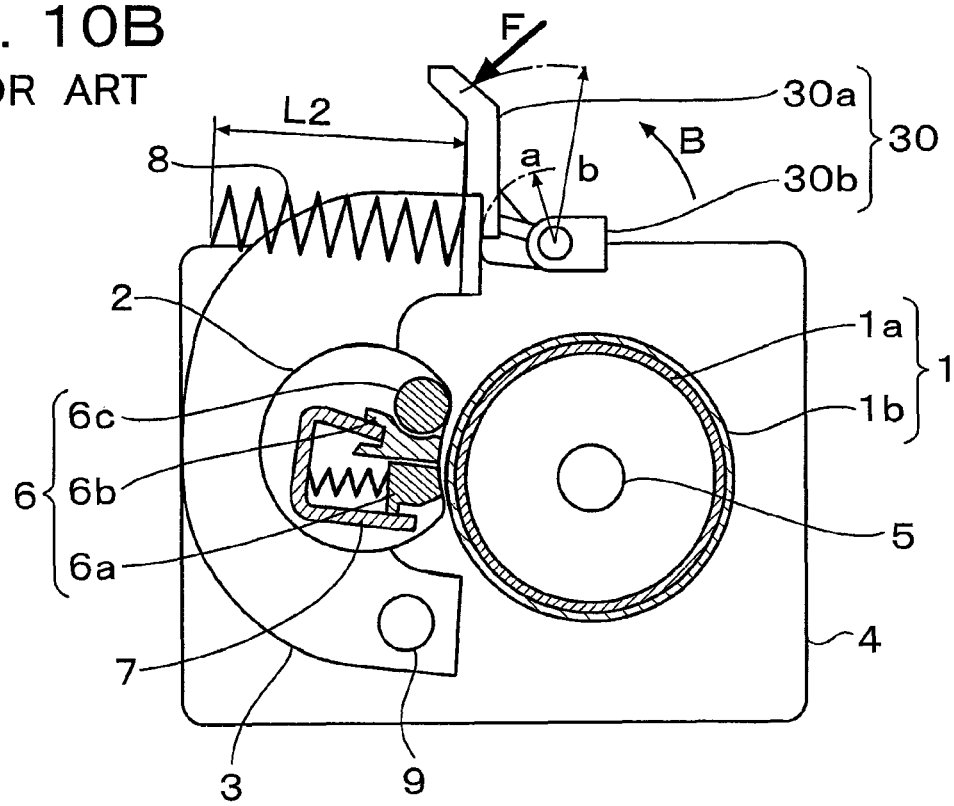
FIG. 10B PRIOR ART

As a result, each pressure spring 8 has a spring length L2 which is longer than the spring length L1 in FIG. 2A by the gap g. Thus, a load corresponding to the spring deformation quantity corresponding to the gap g is released. In addition, loads P' caused by the pressure springs 8 are received by the stoppers 31 respectively. Thus, the pressure arms 3 rotate around the contact points with the stoppers 31 respectively. The operating force of each operating lever 30*a* reduces the load of each pressure spring 8. It is therefore possible to reduce the operating force in comparison with that in the background-art system shown in FIGS. 10A and 10B.

The pressure belt 2, the pressure member 6 and the shaft 9 are integrated. Accordingly, a contact load W' applied to the heating roller 1 by the pressure belt 2 becomes equal to a component force applied to the heating roller 1 by combined gravity G of the pressure belt 2, the pressure member 6 and the shaft 9 in the contact direction, that is, an angular component (=G sin $\phi$) between the contact point of each stopper 31 and each pressure arm 3 and the point of application of the nip load W as shown by the angle $\phi$ in FIG. 2B.

In this embodiment, the combined gravity G is 9.8[N] and the angle $\phi$ is 15°. The nip load W' in FIG. 2B where the load has been reduced becomes 2.5[N]. It is therefore possible to reduce the nip load W'. Thus, even if jammed paper is nipped in the nip portion, the user can pull the jammed paper out of the nip portion easily.

Figure 9A:
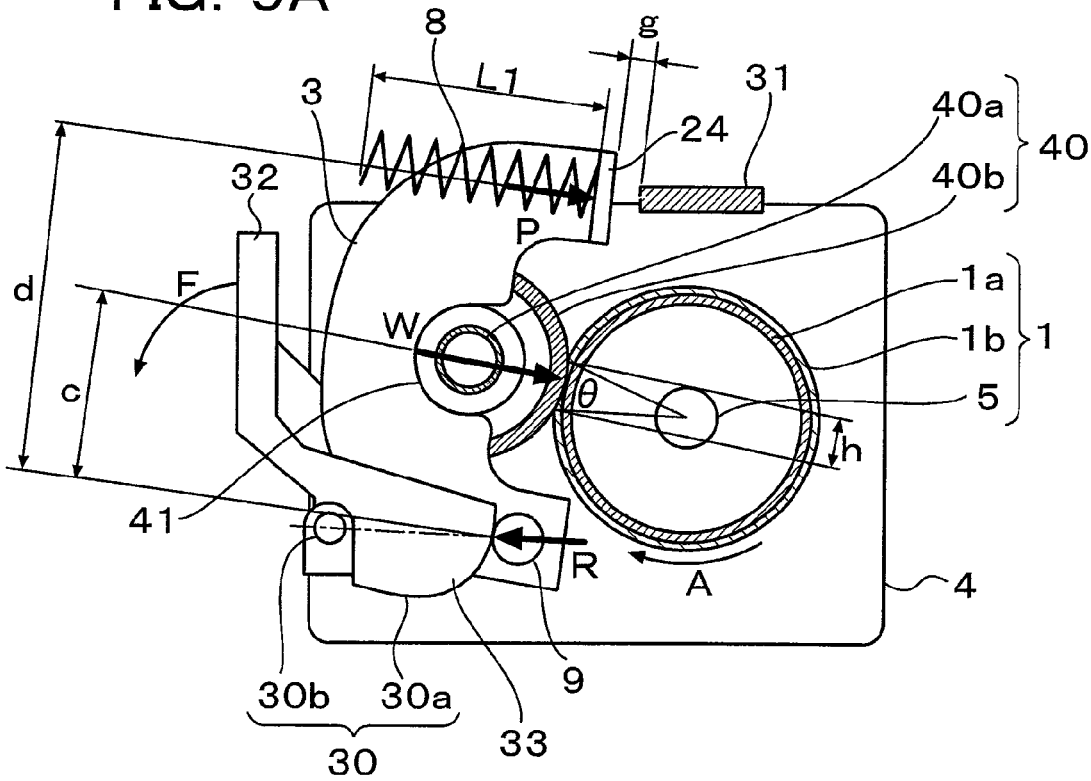
FIGS. 9A and 9B are partially sectional side views of a fixing unit according to another embodiment of the present invention.
Figure 9B:
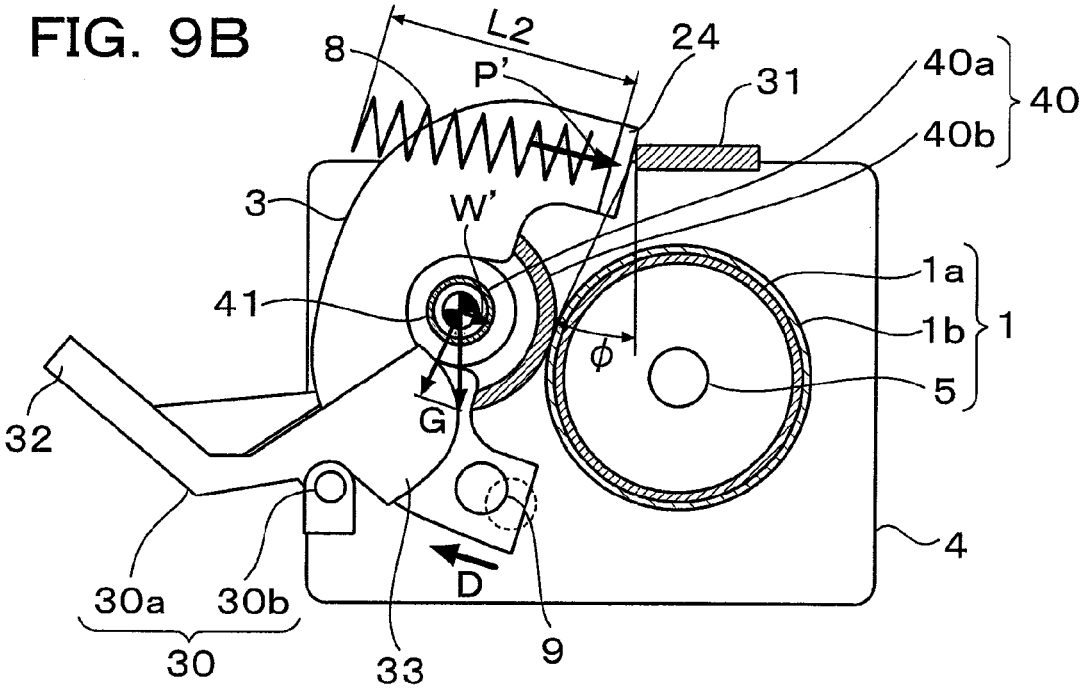

FIGS. 9A and 9B are sectional views showing another embodiment of the present invention. This embodiment shows an example where the pressure belt 2 is replaced by a pressure roller 40, and a nip portion is formed between the pressure roller 40 and a heating roller 1. FIG. 9A is a view showing the case where a toner image is being fixed to paper, that is, the pressure roller 40 is in normal contact with the heating roller 1. FIG. 9B is a view showing the state where in order to remove jammed paper, a user has operated operating levers 30*a* so as to reduce the contact load applied to the heating roller 1 by the pressure roller 40.

The fixing unit according to this embodiment is chiefly constituted by the heating roller 1, pressure arms 3, side plates 4 and the pressure roller 40. The heating roller 1 is an elastic roller in which a core 1*a* is coated with an elastic layer 1*b* made of silicon rubber. A thin film made of PFA (tetrafluoride-perfluoroalkylvinyl ether copolymer) is formed on the surface of the elastic roller 1 in order to secure releasability from toner. The heating roller 1 has a heater 5 in it. Toner is fused by heat from the heater 5. The opposite end portions of the heating roller 1 are rotatably supported on the two side plates 4 and 4 respectively. The heating roller 1 is driven and rotated in the arrow A direction by a not-shown motor.

The pressure roller 40 is an elastic roller in which a core 40*a* is coated with an elastic layer 40*b* made of silicon rubber. A thin film made of PFA (tetrafluoride-perfluoroalkylvinyl ether copolymer) is formed on the surface of the pressure roller 40 in order to secure releasability from toner.

The opposite end portions of the core 40*a* are narrowed. The narrowed end portions are fitted into bearings 41 so as to be rotatably held on the pressure arms 3 respectively. At the same time, the pressure roller 40 is brought into contact with the heating roller 1 at an angle θ of contact by pressure springs 8 in cooperation with the pressure arms 3 respectively with a shaft 9 provided on the side plates 4 as a base point. Thus, the pressure roller 40 forms a contact portion (nip portion) h for fusing toner between the heating roller 1 and the pressure roller 40.

Each operating lever 30*a* is supported by a rotary support shaft 30*b*. As shown in FIG. 9A, a contact portion 33 of the operating lever 30*a* is brought into contact with the shaft 9 so as to position the shaft 9. The rotary support shaft 30*b* is provided in the same direction as a reaction force R acts on the shaft 9. Thus, rotation moment can be prevented from acting on the operating lever 30*a* due to the counter force R.

In the normal state, stoppers 31 fixed to upper portions of the side plates 4 are opposed to tip portions (spring contact portions) 24 of the pressure arms 3 respectively through a gap g as shown in FIG. 9A. Each stopper 31 has a function of regulating the displacement of its corresponding pressure arm 3 when the load of the pressure roller 40 is released as shown in FIG. 9B.

Next, description will be made about forces acting on respective portions in the state of FIG. 9A, that is, in the state where the pressure roller 40 is in normal contact with the heating roller 1.

Assume that a pressure spring force P acts on the tip of each pressure arm 3 in accordance with spring length L1 of each pressure spring 8, a total nip load W acts on nip width h of the pressure roller 40 in contact with the heating roller 1, and a reaction force R acts on the shaft 9. When c and d designate a distance between the center of the shaft 9 and a point of application of the nip load W and a distance between the center of the shaft 9 and a point of application of the pressure spring 8 respectively, the following relations are established by equilibrium of force and equilibrium of moment.

$$cW=2dP$$

$$2P=W+2R$$

From the above expressions, the reaction force R can be expressed by R=(1−d/c)P (where the direction of the spring load P of the pressure spring 8 is positive).

Next, description will be made about the operation where a user operates the operating levers 30*a* to reduce the contact load applied to the heating roller 1 by the pressure roller 40 in order to remove jammed paper.

When the user rotates knob portions 32 of the operating levers 30*a* in the direction of the illustrated arrow F as shown in FIG. 9A, the operating levers 30*a* rotate around the rotary support shafts 30*b* so that the contact portions 33 of the operating levers 30*a* are detached from the shaft 9. The shaft 9 loses the support of the contact portions 33. Thus the shaft 9 is moved in the arrow D direction within each long hole 4*a* by the aforementioned reaction force R while the tip portions (spring contact portions 24) of the pressure arms 3 are displaced to come in contact with the stoppers 31 by the loads of the pressure springs 8 respectively.

As a result, each pressure spring 8 has a spring length L2 which is longer than the spring length L1 in FIG. 9A by the gap g. Thus, a load corresponding to the spring deformation quantity corresponding to the gap g is released. In addition, a load P' caused by each pressure spring 8 is received by each stopper 31. Thus, the pressure arms 3 rotate around the contact points with the stoppers 31 respectively. The operating force of each operating lever 30*a* reduces the load of each pressure spring 8. It is therefore possible to reduce the operating force in comparison with that in the background-art system shown in FIGS. 10A and 10B.

The pressure roller 40 and the shaft 9 are integrated. Accordingly, a contact load W' applied to the heating roller 1 by the pressure roller 40 becomes equal to a component force applied to the heating roller 1 by combined gravity G of the pressure roller 40 and the shaft 9 in the contact direction, that is, an angular component (=G sin ϕ) between the contact point of each stopper 31 and each pressure arm 3 and the point of application of the nip load W as shown by the angle ϕ in FIG. 9B.

In this embodiment, the combined gravity G is 9.8 [N] and the angle ϕ is 15°. The nip load W' in FIG. 9B where the load has been reduced becomes 2.5[N]. It is therefore possible to reduce the nip load W'. Thus, even if jammed paper is nipped in the nip portion, the user can pull the jammed paper out of the nip portion easily.

According to the present invention, as has been described above, it is possible to provide a fixing unit and an image forming apparatus in which operating levers and the apparatus are not increased in size, but an operating force for releasing a nip can be reduced by a small-sized and low-priced configuration while the unit and the apparatus are user-friendly.

What is claimed is:

1. A fixing unit comprising:

a heating member including a heating element;

a pressure conveyance member for conveying a recording medium, which is carrying a toner image, in cooperation with the heating member while pressing the recording medium toward the heating member;

support members which can rotatably support opposite end portions of the pressure conveyance member respectively;

pressure springs which can apply a predetermined load to the pressure conveyance member through the support members respectively so as to press the pressure conveyance member toward the heating member;

nip load releasing units which can release the load applied to the pressure conveyance member by the pressure springs respectively; and stoppers which are fixed through a gap to the one end portions of the support members brought into contact with the pressure springs and on opposite side to the pressure springs respectively; wherein:

the pressure conveyance member is supported in an intermediate position between the support members, while one end portions of the support members are brought into contact with the pressure springs respectively;

the other end portions of the support members on the opposite side to the pressure springs are brought into contact with the nip load releasing units respectively through the pressure conveyance member; and when the load applied to the pressure conveyance member is released by the nip load releasing units, the one end portions of the support members are brought into contact with the stoppers, and the support members rotate around contact points with the stoppers respectively so as to move away from the heating member.

2. A fixing unit according to claim 1, wherein:

each of the nip load releasing units has an operating lever and a rotary support shaft which rotatably supports the operating lever;

the rotary support shafts are attached respectively to side plates which rotatably support opposite end portions of the heating member on both sides respectively;

a shaft for connecting the support members which rotatably support the opposite end portions of the pressure conveyance member on the both sides respectively is provided so that opposite end portions of the shaft project outside over the support members respectively, while long holes to which the opposite end portions of the shaft can be fitted are formed in the side plates respectively;

when the pressure conveyance member is being pressed toward the heating member, the operating levers of the nip load releasing units are brought into contact with portions of the shaft respectively, and the opposite end portions of the shaft are pressed onto one end portions of the long holes respectively so that the shaft is positioned; and when the load applied to the pressure conveyance member is to be released, the operating levers of the nip load releasing units are rotated to release the shaft from pressure, so that the opposite end portions of the shaft move along the long holes respectively due to a reaction force applied to the pressure conveyance member by the heating member.

3. A fixing unit according to claim 2, wherein the rotary support shafts of the nip load releasing units are placed in a direction of the reaction force of the heating member acting on the shaft when the operating levers press the shaft.

4. A fixing unit according to claim 1, further comprising:

a heating unit including the heating member and the side plates which rotatably support opposite end portions of the heating member on both sides respectively; and a pressure unit including the pressure conveyance member and the support members which rotatably support opposite end portions of the pressure conveyance member on the both sides respectively; wherein:

projecting portions which project outside are provided in the support members in positions corresponding to the nip load releasing units respectively, while long holes to which the projecting portions can be fitted are formed in the side plates on the both sides respectively; and when the projecting portions are fitted to the long holes respectively, the pressure unit can be removably attached to the heating unit.

5. A fixing unit according to claim 2, wherein the long holes are long holes which are narrowed toward inner sides of the side plates respectively, and each long hole has a U-groove shape in which a notch portion is formed in one end thereof, while the long holes face in directions where the other end portions of the support members can move away from the heating member respectively when the load applied to the pressure conveyance member is to be released.

6. A fixing unit according to claim 4, wherein the projecting portions of the support members are opposite end portions of a shaft which connects the support members placed on the both sides and penetrates the support members.

7. An image forming apparatus comprising a photoconductor unit for forming a toner image, a charging unit for charging a surface of the photoconductor unit uniformly, an exposure unit for exposing the charged surface of the photoconductor unit to light so as to form an electrostatic latent image, a developing unit for applying toner to the electrostatic latent image so as to form a toner image, a transfer unit for transferring the toner image to a recording medium, and a fixing unit for fixing the transferred toner image to the recording medium; wherein:

the fixing unit is a fixing unit according to claim 1.

8. A fixing unit according to claim 4, wherein the long holes are long holes which are narrowed toward inner sides of the side plates respectively, and each long hole has a U-groove shape in which a notch portion is formed in one end thereof, while the long holes face in directions where the other end portions of the support members can move away from the heating member respectively when the load applied to the pressure conveyance member is to be released.

* * * * *